US011167558B2

(12) United States Patent
Kimura

(10) Patent No.: US 11,167,558 B2
(45) Date of Patent: Nov. 9, 2021

(54) ELECTRONIC DEVICE AND DRIVE METHOD OF MOTOR

(71) Applicant: CASIO COMPUTER CO., LTD., Tokyo (JP)

(72) Inventor: Satoshi Kimura, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/803,752

(22) Filed: Feb. 27, 2020

(65) Prior Publication Data

US 2020/0276822 A1 Sep. 3, 2020

(30) Foreign Application Priority Data

Feb. 28, 2019 (JP) ..... JP2019-036196

(51) Int. Cl.
*B41J 29/38* (2006.01)
*B41J 2/175* (2006.01)

(52) U.S. Cl.
CPC ..... *B41J 2/1752* (2013.01)

(58) Field of Classification Search
None
See application file for complete search history.

(56) References Cited

U.S. PATENT DOCUMENTS

2005/0052510 A1* 3/2005 Ju ..... B41J 2/1752 347/86
2006/0221412 A1* 10/2006 Terada ..... H04N 1/00588 358/498
2013/0038647 A1* 2/2013 Hashimoto ..... B41J 29/02 347/2
2013/0155152 A1* 6/2013 Govyadinov ..... F04B 19/24 347/54

FOREIGN PATENT DOCUMENTS

JP H06-255197 A 9/1994
JP H08-258359 A 10/1996
JP H10-164893 A 6/1998
JP 2007-160560 A 6/2007
JP 2012-250502 A 12/2012
JP 2015-205437 A 11/2015

* cited by examiner

*Primary Examiner* — Erica S Lin
*Assistant Examiner* — Tracey M McMillion
(74) *Attorney, Agent, or Firm* — Fitch, Even, Tabin & Flannery LLP

(57) ABSTRACT

Disclosed is an electronic device including: a cartridge holder that holds a cartridge; a motor for moving the cartridge holder in a moving direction; and a motor control circuit that controls a movement in the moving direction of the cartridge holder by the motor, wherein the motor control circuit applies a voltage or a current to the motor to apply, to the cartridge holder, a resisting force in a direction facing an external force, against the external force which is applied along the moving direction to the cartridge holder through the cartridge so as to mount the cartridge in the cartridge holder from the moving direction.

14 Claims, 9 Drawing Sheets

ELECTRONIC DEVICE AND DRIVE METHOD OF MOTOR

CROSS-REFERENCE TO RELATED APPLICATION

This application is based upon and claims the benefit of priority from the prior Japanese Patent Application No. 2019-036196, filed on Feb. 28, 2019, the entire contents of which are incorporated herein by reference.

BACKGROUND OF THE INVENTION

1. Field of the Invention

The present invention relates to an electronic device and a drive method of a motor.

2. Description of the Related Art

Conventionally, among electronic devices that perform printing such as printing devices, there is known an electronic device in which a cartridge that stores ink is configured to be replaceable and a printing operation is performed by mounting the cartridge on a cartridge holder (carriage).

When the cartridge is replaceable, the cartridge needs to be mounted on the device (cartridge holder) by the user. When the cartridge cannot be correctly mounted, the printing operation cannot be performed properly.

In this regard, there has been suggested a printing device (electronic device) that has a printing function and a scanner, the printing device being configured to be able to open and close an operation panel arranged on a side of a glass table on which a scanner document is placed, and configured to mount and remove a cartridge at the position of the operation panel (refer to, for example, JP 2015205437 A).

In the printing device described in JP 2015205437 A, after the operation panel is opened upward, the cartridge is mounted on the cartridge holder (carriage in JP 2015205437 A) so as to press the cartridge downward from above.

SUMMARY OF THE INVENTION

In order to solve the above problems, an electronic device according to the present invention includes: a cartridge holder that holds a cartridge; a motor for moving the cartridge holder in a moving direction; and a motor control circuit that controls a movement in the moving direction of the cartridge holder by the motor, wherein the motor control circuit applies a voltage or a current to the motor to apply, to the cartridge holder, a resisting force in a direction facing an external force, against the external force which is applied along the moving direction to the cartridge holder through the cartridge so as to mount the cartridge in the cartridge holder from the moving direction.

BRIEF DESCRIPTION OF THE DRAWINGS

The accompanying drawings are not intended as a definition of the limits of the invention but illustrate embodiments of the invention, and together with the general description given above and the detailed description of the embodiments given below, serve to explain the principles of the invention, wherein.

DETAILED DESCRIPTION OF THE PREFERRED EMBODIMENTS

An embodiment of an electronic device according to the present invention will be described with reference to FIGS. 1 to 13.

The embodiment described below is provided with various limitations technically preferable for carrying out the present invention. However, the scope of the present invention is not limited to the embodiment below or illustrated examples.

Further, in the following embodiment, a case where the electronic device is a nail printing device that is a printing device which performs printing on a fingernail of a hand as a print target will be described as an example. However, the electronic device according to the present invention is not limited to a printing device such as a nail printing device, and the electronic device may be any device that can be used with a cartridge mounted in a cartridge holder. Further, the print target of the printing device (nail printing device) as the electronic device is not limited to the fingernail of the hand, and for example, the nail of the toe may be the print target. The print target may also be targets other than nails, such as nail tips and surfaces of various accessories.

Figure 1:
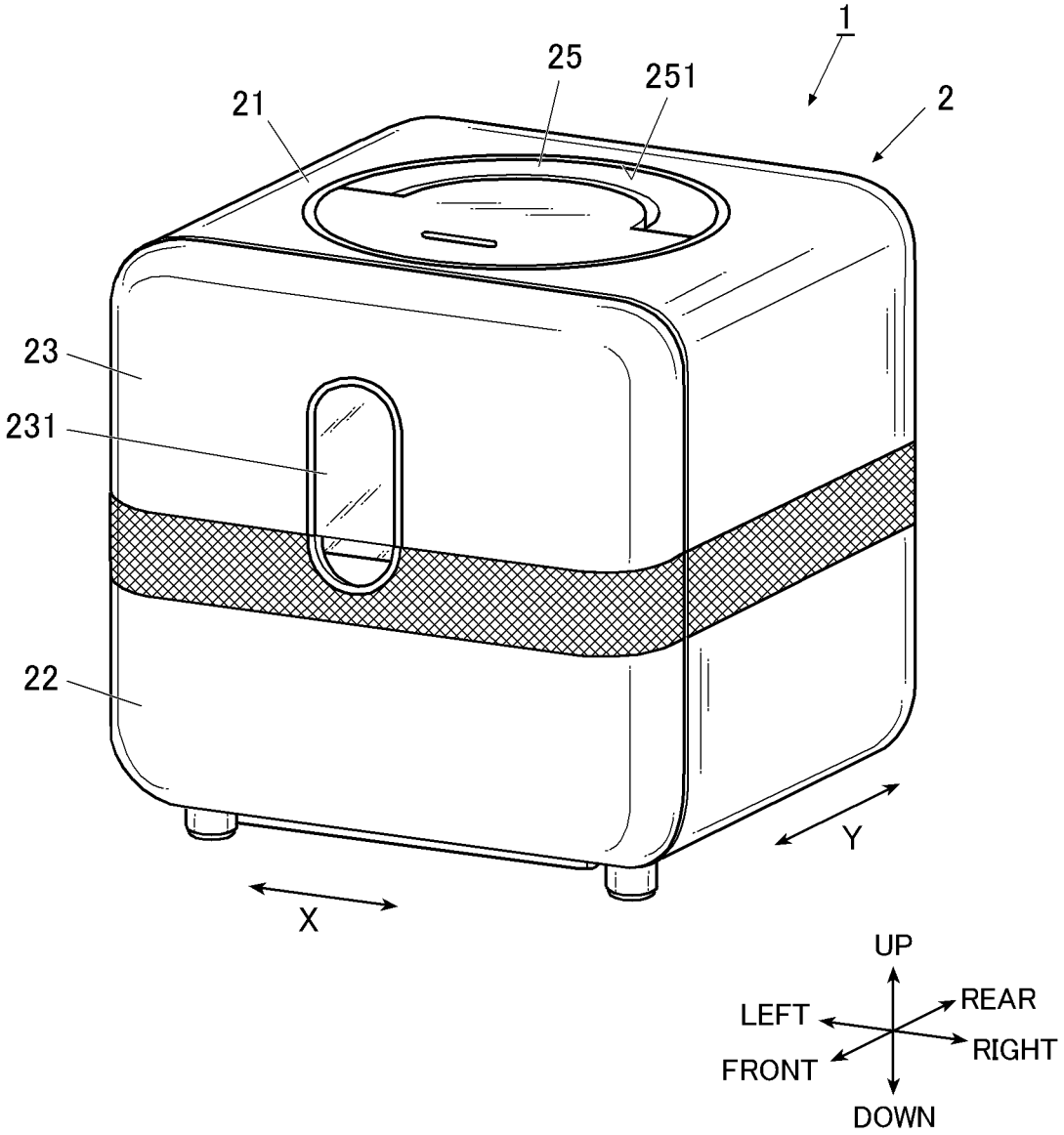
FIG. 1 is a perspective view showing the external appearance of a nail printing device according to an embodiment.

FIG. 1 is a perspective view showing an external configuration of a nail printing device (nail printing device 1) which is an electronic device in the present embodiment.

In the following embodiment, the up, down, left and right, and front and rear refer to the directions shown in FIG. 1. Further, the X direction and the Y direction refer to the directions shown in FIG. 1.

As shown in FIG. 1, the nail printing device 1 has a housing 2 which is formed to be substantially box-shaped.

The housing 2 has a housing body 21 that has an opening 211 on the front surface side (front surface side of the nail printing device 1 and the front side in FIG. 1), and a lower cover 22 and an upper cover 23 that are arranged on the front surface side of the housing body 21 and close the opening 211.

That is, in the present embodiment, the front surface of the housing 2 is divided in substantially half vertically in the height direction of the housing 2. The lower cover 22 forms the lower side of the front surface and the upper cover 23 forms the upper side of the front surface. The lower cover 22 and the upper cover 23 are substantially flush with each other in the closed state.

A front wall portion 212 (refer to FIG. 3) is provided on the upper front side of the housing body 21 and inside the upper cover 23. A part of the front wall portion 212 is notched to be open, and serves as a removal port 213 (opening for attaching and detaching of a cartridge 7) when a later-described cartridge 7 is attached to and detached from the nail printing device 1.

As will be described later, in the present embodiment, a home position Ar1 (standby area during non-printing) of the cartridge 7 is provided on the right side in the width direction (X direction) in the nail printing device 1, and a replacement area Ar3 when the cartridge 7 is attached, detached or replaced is located at the position moved straight from this home position Ar1 toward the front side of the nail printing device 1 in the Y direction.

At a position corresponding to this replacement area Ar3, the removal port 213 is formed of such a degree of size that the cartridge 7 is not caught when the cartridge 7 is attached or detached.

The lower cover 22 is attachable to and detachable from the housing body 21.

Figure 2:
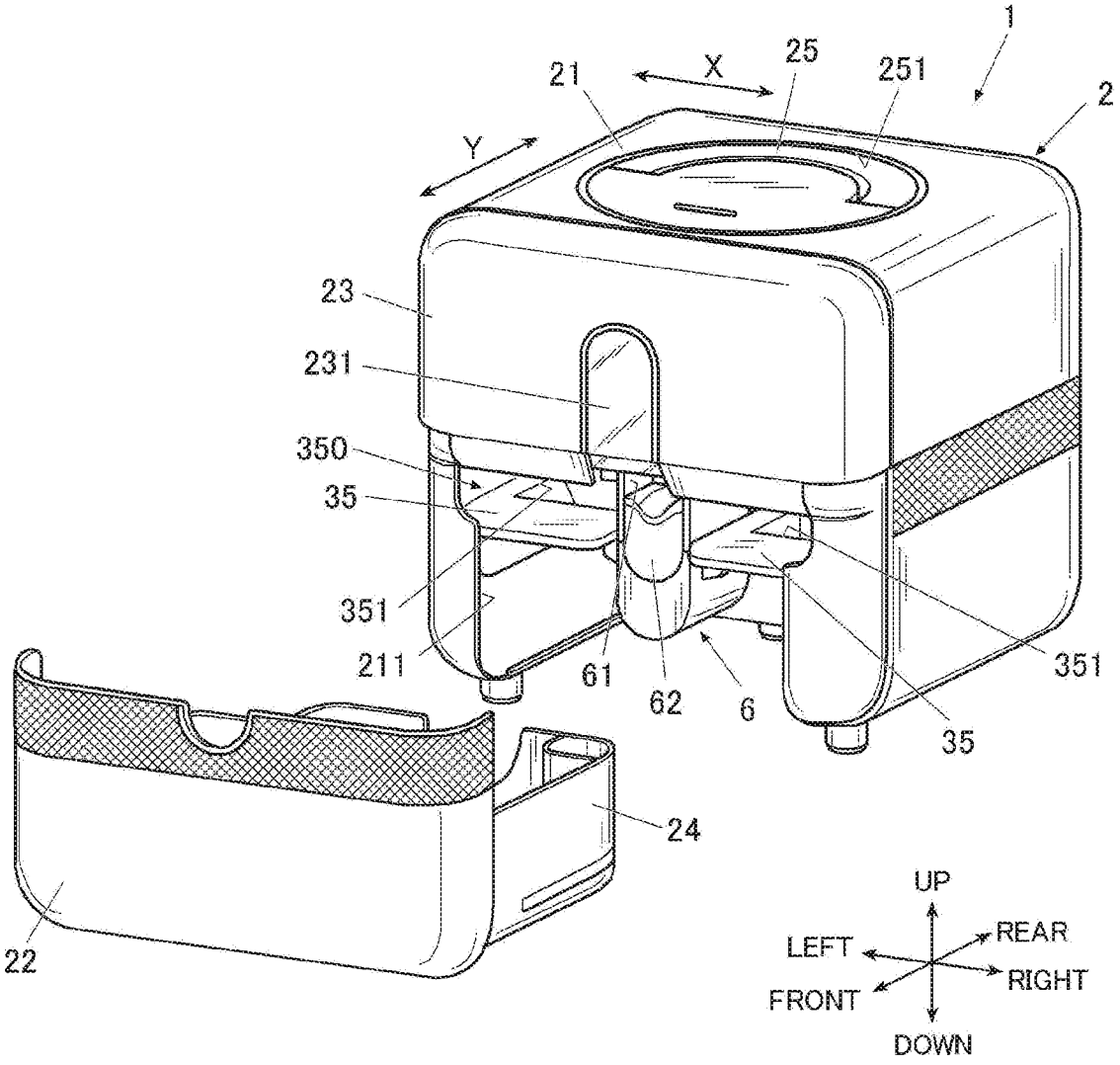
FIG. 2 is a perspective view showing a state in which the lower cover is removed from the nail printing device shown in FIG. 1.

FIG. 2 is a perspective view showing a state in which the lower cover is removed from the housing.

As shown in FIG. 2, by removing the lower cover 22, a finger fixing unit 6 and a finger standby unit 350 to be described later are exposed from the opening 211 of the housing body 21. Each nail that is a print target (finger corresponding to the nail (hereinafter referred to as a printing finger) is not shown in the drawings) and fingers other than the printing finger (not shown in the drawings, hereinafter referred to as non-printing fingers) can be inserted into the nail printing device 1.

In addition, on the back side (rear side in FIG. 1) of the lower cover 22, a drawer portion 24 that is accommodated inside the housing 2 when the lower cover 22 is attached to the housing body 21 is integrally formed. The drawer portion 24 may be an accessory case that can store various parts (not shown in the drawings) provided with the nail printing device 1, for example.

The upper cover 23 is rotatably connected to the housing body 21 via a hinge mechanism 214 provided at the upper end portion of the front wall portion 212 or the front end portion of the upper surface (top plate) of the housing body 21. The hinge mechanism 214 is preferably composed of slide hinges or the like so as not to appear on the exterior of the housing 2.

The upper cover 23 is rotatable from a closed state covering the front side of the housing body 21 to an open state in which the front side of the housing body 21 is opened (state in which the front wall portion 212 is exposed in the present embodiment).

Figure 3:
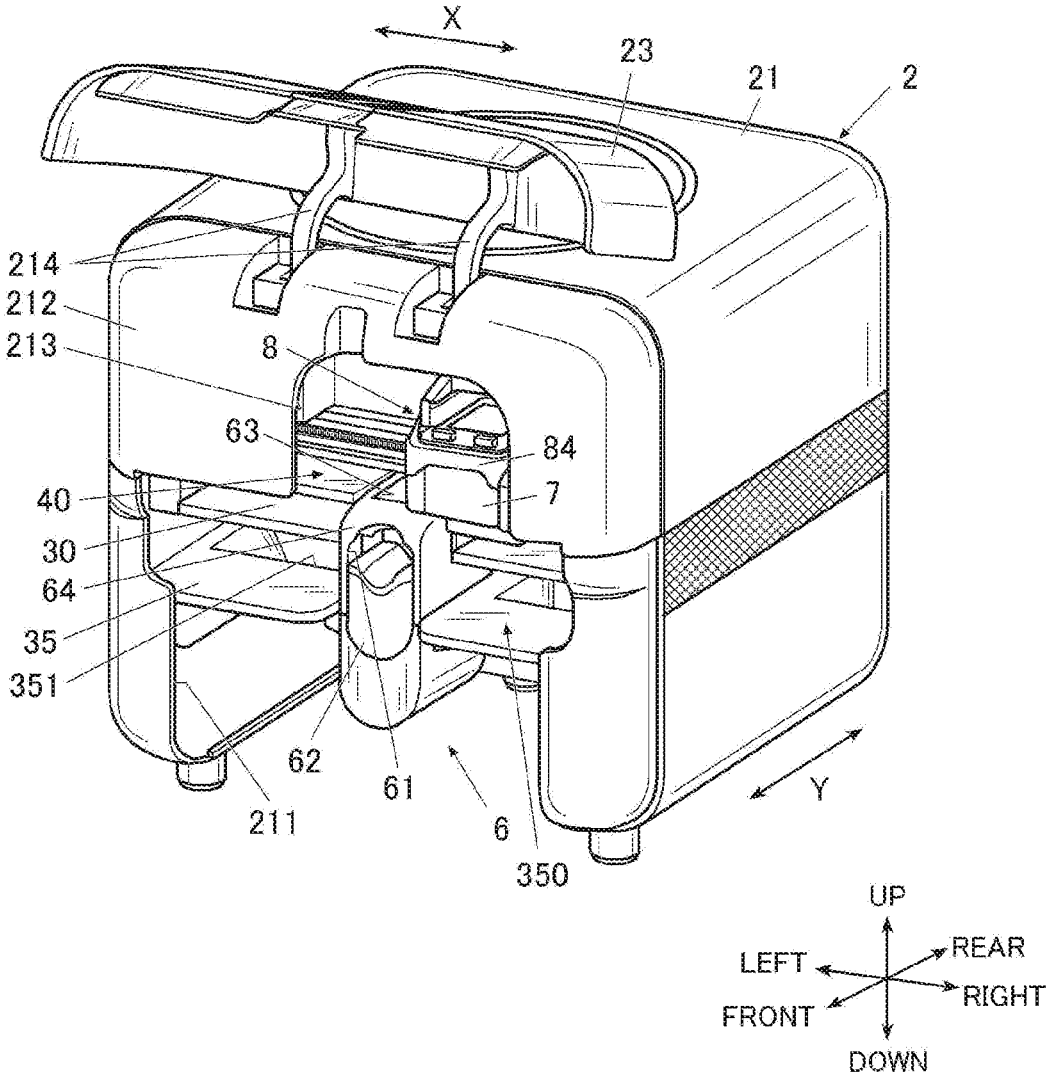
FIG. 3 is a perspective view showing a state in which the lower cover is removed from the nail printing device shown in FIG. 1 and the upper cover is opened.

FIG. 3 is a perspective view of the nail printing device 1 with the upper cover 23 in an open state. FIG. 3 shows a state in which the cartridge 7 is mounted.

In the present embodiment, as shown in FIG. 3, the upper cover 23 rotates in front of the housing 2 in the open state. In the example shown in FIG. 3, the upper cover 23 is raised to a position higher than the upper surface of the housing 2 in the open state. However, the height position of the upper cover 23 in the open state is not limited to the illustrated example.

As described above, the lower cover 22 and the upper cover 23 are configured to be removable or openable toward the front of the nail printing device 1. Thus, even when the nail printing device 1 is stored in a place where there is no sufficient space in the height direction, it is possible to perform printing or the like without taking out the nail printing device 1 from the storage location.

In the upper cover 23, a window portion 231, to which a transparent member made of transparent plastic or the like is attached, is provided at a substantially central portion in the width direction (left-right direction of the nail printing device 1, X direction in FIG. 1, for example) of the housing 2.

From the window portion 231, the inside of the nail printing device 1, particularly the finger fixing unit 6 (to be described later) where the nail that is a print target is arranged can be visually observed from the outside.

A handle 25 is provided at substantially the center of the upper surface of the housing 2.

A recess portion 251 is formed on the upper surface of the housing 2, and the handle 25 can be stored in the recess portion 251. The handle 25 is substantially flush with the upper surface of the housing 2 in the storage state (state shown in FIG. 1, for example) stored in the recess portion 251. Thereby, the nail printing device 1 can be arranged as long as there is a gap corresponding to the height of the housing 2, and space saving when the nail printing device 1 is stored can be achieved.

The handle 25 serves as a handle for carrying the nail printing device 1 in the raised state raised from the inside of the recess portion 251.

The shape, arrangement and the like of each part of the housing 2 are not limited to the example of illustration, and can be set as needed. For example, a power switch button for turning on/off the power of the nail printing device 1 and various display units may be provided on the upper surface or lateral surface of the housing 2.

On the internal side of the upper surface (top board) of the housing 2, above an opening 63 of a finger fixing unit 6 to be described later, an imaging unit 50 (refer to FIG. 10) is arranged. The imaging unit 50 images the nail (printing finger including the nail) exposed from the opening 63, and thereby obtains the nail image.

Figure 4:
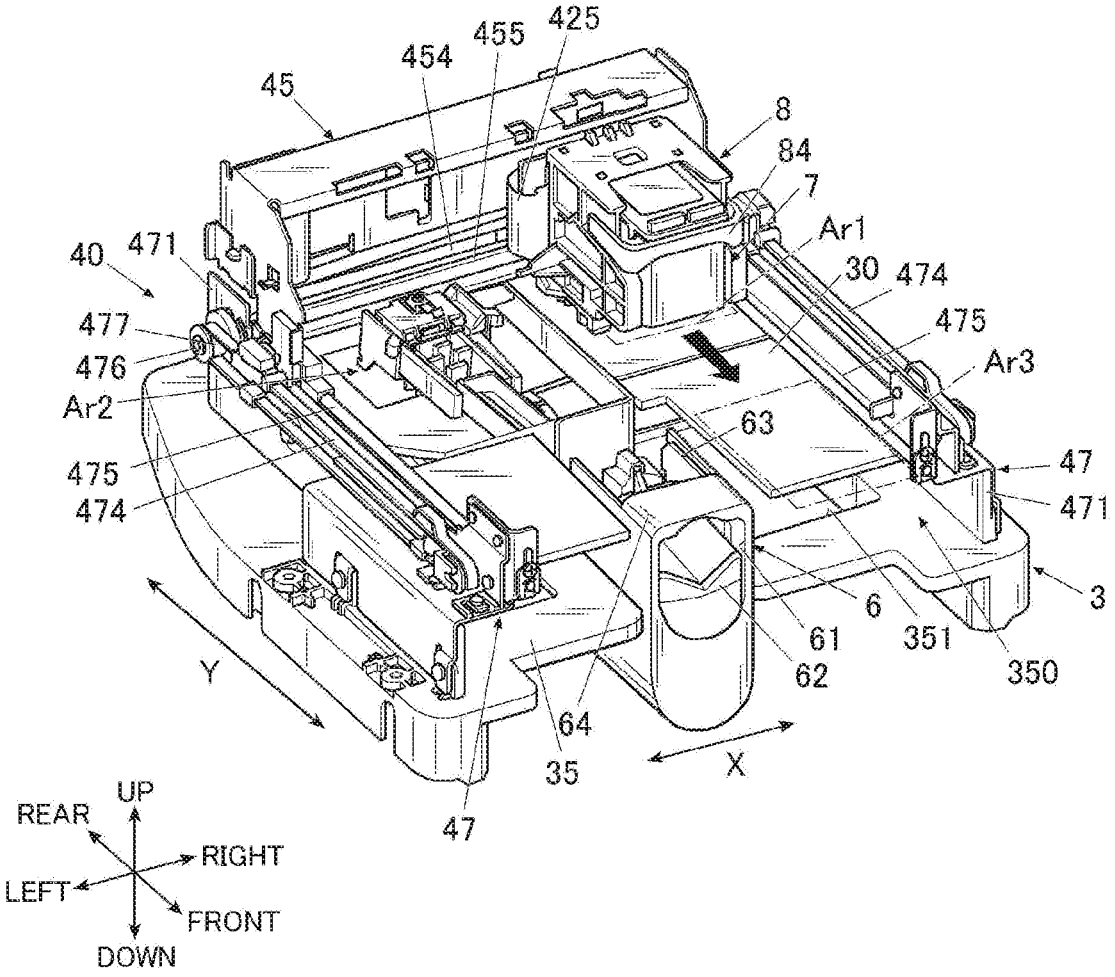
FIG. 4 is a perspective view showing internal components of the nail printing device according to the embodiment.

FIG. 4 is a perspective view of the main parts showing the internal configuration of the nail printing device 1 with the housing 2 removed from the nail printing device 1 shown in FIG. 1, for example.

As shown in FIG. 4, a base 3 in which various internal structures are incorporated is provided in the housing 2.

The upper surface of the base 3 is a base upper surface(s) 30 which is substantially flat. The base upper surface 30 is arranged at a height that is substantially flush with the surface of the nail (print target surface) in a state in which the printing finger is fixed to the finger fixing unit 6.

The finger fixing unit 6 is arranged at a front side (front side) portion of the base upper surface 30 and at a substantially central portion in the left-right direction.

The finger fixing unit 6 is a box-like member having an opening 61 that opens to the front side of the nail printing device 1, and a finger fixing member 62 that fixes a printing finger is arranged inside the finger fixing unit 6.

The finger fixing member 62 pushes and supports the printing finger from below, and is formed of, for example, a flexible resin. In the present embodiment, the finger fixing member 62 has a shape in which a substantially central portion in the width direction (left-right direction) is recessed. Thereby, when the printing finger is placed on the finger fixing member 62, it is possible to prevent the finger from rattling in the left-right direction by the finger fixing member 62 receiving the belly portion of the printing finger.

The back portion (rear portion in the Y direction) of the top surface of the finger fixing unit 6 is opened and forms the opening 63. From the opening 63, the nail of the finger inserted into the finger fixing unit 6 is exposed.

In the present embodiment, printing is performed by a printing unit 40 to be described later in a region where the opening 63 is provided.

On the front side (front side in Y direction) of the top surface, the finger fixing unit 6 forms a finger presser 64 which prevents the printing finger from floating (rising) and regulates the position of the printing finger in the upward direction.

The printing finger is supported by the finger fixing member 62 from the lower side, and the upper side of the printing finger is pressed by the finger presser 64, so that the position in the height direction of the surface (print target surface) of the nail of the printing finger is determined at a predetermined position suitable for printing by the printing unit 40.

There are provided partition plates 35 substantially parallel to the base upper surface 30 at a height position below the base upper surface 30 and not interfering with the drawer portion 24. The partition plates 35 include finger inserting portions 351 configured by including recesses or holes.

A space between the base upper surface 30 and the partition plates 35 serves as a finger standby unit 350 that makes the non-printing fingers standby when printing is performed on the nail of the printing finger.

During printing, the user inserts the non-printing fingers on standby into the finger standby unit 350, and the fingertips are appropriately inserted into the finger inserting portions 351, so that the non-printing fingers can be kept in a stable state without difficulty. Thus, the printing finger is not burdened, and movement of the printing finger during printing is less likely to occur.

Further, since the fingertips of the non-printing fingers can be put in the finger inserting portions 351, for example, it is possible to prevent the fingernail(s) that has already been printed from coming into contact with any part of the nail printing device 1. Thereby, there is no possibility that the printed nail is rubbed or damaged, and it is possible to prevent the dirt from adhering to the inside of the nail printing device 1.

On the back side (rear side in the Y direction) of the base upper surface 30 with respect to the finger fixing unit 6, a home position Ar1 to be described later that is a waiting area for the cartridge 7 during non-printing time, and a maintenance area Ar2 for performing maintenance such as cleaning of the cartridge 7 during the non-printing time are provided.

In the present embodiment, as shown in FIG. 4, the home position Ar1 is arranged on the right side in the width direction (X direction) in the nail printing device 1, and the maintenance area Ar2 is arranged on the left side.

Further, the position moved straight forward in the Y direction from the home position Ar1 to the front of the removal port 213 is a replacement area Ar3 in which a cartridge holder 8 is arranged when the cartridge 7 is attached, detached or replaced.

As shown in FIG. 4, a printing unit 40 that prints on the print target surface is provided inside the housing 2. Here, the print target surface is the surface to be printed. In the present embodiment, the print target surface is the surface of the fingernail.

The printing unit 40 includes: the cartridge 7 that functions as a print head; the cartridge holder 8 that supports the cartridge 7; an X-direction moving stage 45 and an X-direction moving motor 46 (refer to FIG. 10) for moving the cartridge 7 in the X direction along the left-right direction; and Y-direction moving stages 47 and a Y-direction moving motor 48 (refer to FIG. 10) for moving the cartridge 7 in the Y direction along the front-rear direction.

The Y-direction moving stages 47 have support members 471 provided on both sides of the base upper surface 30 in the left-right direction so as to extend in the front-rear direction (Y direction).

To both ends in the extending direction of each of the support members 471 which form a pair, pulleys 477 are attached. Around the pulleys 477 on the left and right side of the nail printing device 1, respective drive belts 474 extending in the front-rear direction are wounded.

The pulleys 477 provided on the rear side of the nail printing device 1 are attached to both ends of a drive shaft portion 476. The Y-direction moving motor 48 is connected to the drive shaft portion 476, and when the Y-direction moving motor 48 is driven, the drive shaft portion 476 and the pulleys 477 attached thereto are appropriately rotated in forward and reverse directions as needed.

The rotation of pulleys 477 rotates the drive belts 474 wounded around the pulleys 477, so that the X-direction moving stage 45 (and the cartridge 7 mounted on the X-direction moving stage 45) can move in the Y direction.

On the support members 471, guide shafts 475 extending in the front-rear direction are arranged parallel to the drive belts 474.

The X-direction moving stage 45 is formed in a rectangular box shape extending in the left-right direction (X direction), and is provided at the rear end portion of the base upper surface 30.

Into the right and left ends of the X-direction moving stage 45, the guide shafts 475 are inserted, respectively. When the Y-direction moving motor 48 is driven, the drive belts 474 rotate, so that the X-direction moving stage 45 can move in the Y direction along the guide shafts 475.

Pulleys (not shown in the drawings) are provided inside the X-direction moving stage 45, and a drive belt 454 extending in the left-right direction is wound around the pulleys. In the X-direction moving stage 45, a guide shaft 455 extending in the left-right direction is arranged substantially parallel to the drive belt 454.

The cartridge holder 8 is mounted on the X-direction moving stage 45.

On the back side of the cartridge holder 8 (rear side in FIG. 4), a holder support member 85 (which will be described later, refer to FIG. 6, for example) through which the guide shaft 455 is inserted is provided.

The cartridge holder 8 is movable in the X direction along the guide shaft 455 in the X-direction moving stage 45 by the X-direction moving motor 46 driving and the drive belt 454 rotating.

In the present embodiment, the X-direction moving motor 46 and the Y-direction moving motor 48 are drive motors for moving the cartridge holder 8. The X-direction moving motor 46 and the Y-direction moving motor 48 are provided to be included in a moving mechanism (head moving mechanism 49 in FIG. 10, for example) in the printing unit 40.

Figure 5:
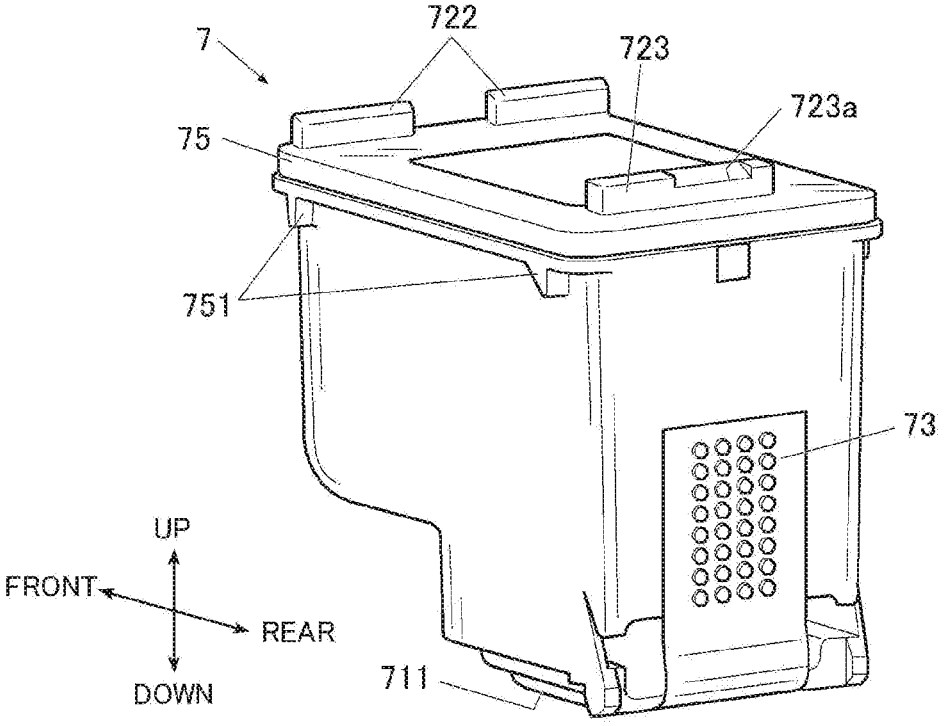
FIG. 5 is a perspective view of main parts of a cartridge according to the embodiment.
Figure 6:
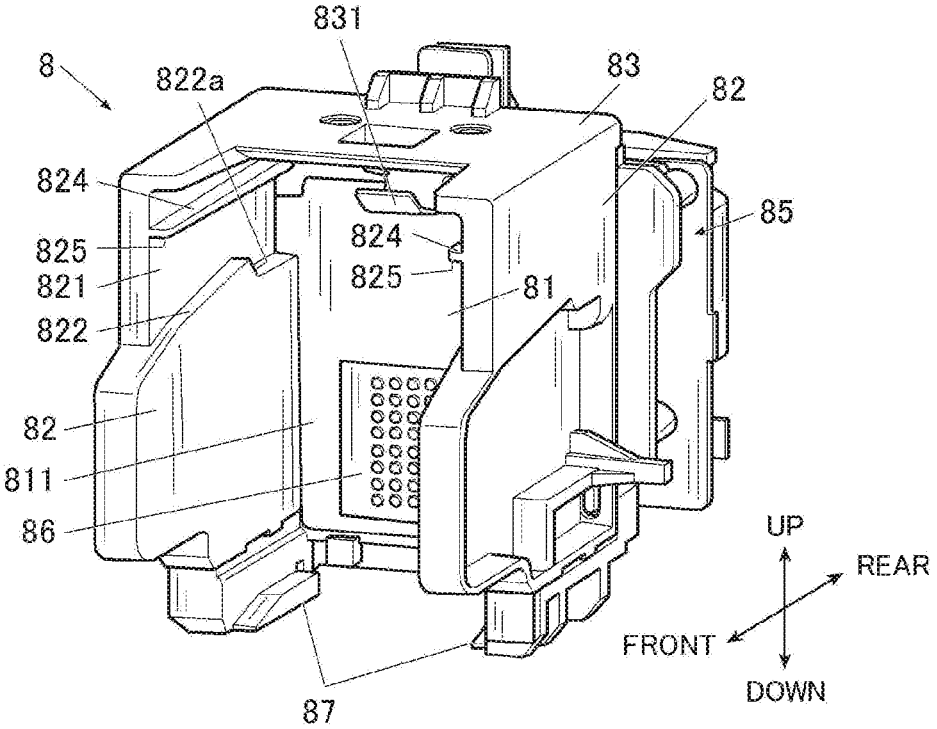
FIG. 6 is a perspective view of a cartridge holder in the embodiment.

FIG. 5 is a perspective view of a main part of the cartridge in the present embodiment. FIG. 6 is a perspective view of a main part of the cartridge holder in the present embodiment.

Figure 7:
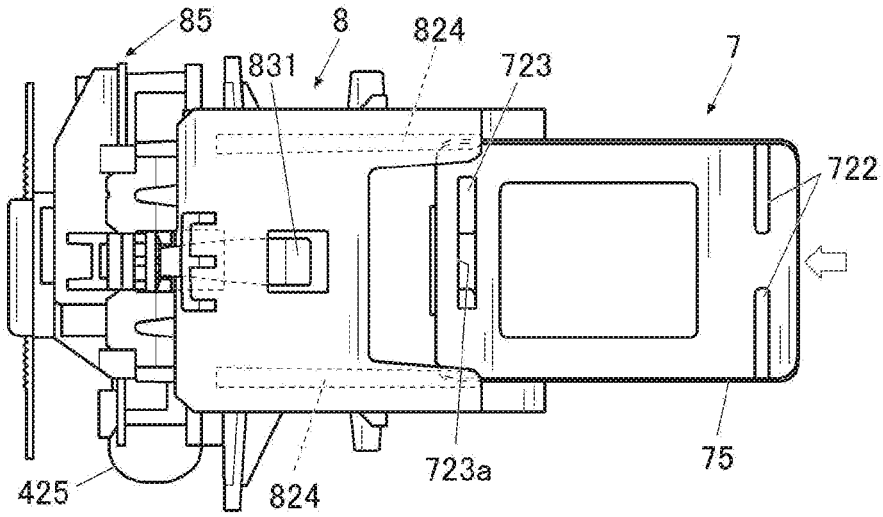
FIG. 7 is a plan view of a state in which the cartridge is being mounted in the cartridge holder as viewed from above.
Figure 8:
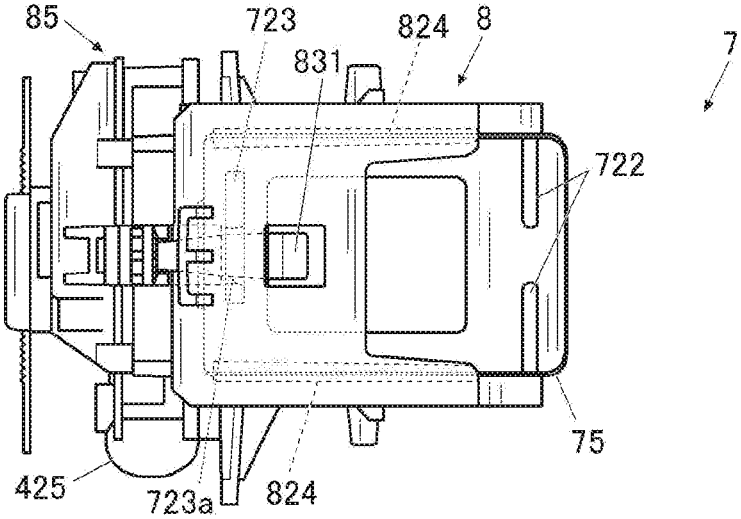
FIG. 8 is a plan view of a state in which the cartridge is mounted in the cartridge holder as viewed from above.

FIG. 7 is a plan view of a state in which the cartridge is being mounted on the cartridge holder as viewed from above. FIG. 8 is a plan view of a state in which the cartridge is mounted on the cartridge holder as viewed from above.

In the present embodiment, the cartridge 7 is a head-integrated ink cartridge that includes ink storages (not shown in the drawings) inside the cartridge 7, and is integrated with a print head mechanism 71 of an inkjet type (refer to FIG. 10) which ejects ink from the ink ejection surface 711 as fine droplets to print on the print target surface.

In other words, the ink ejection surface 711 is integrally formed on the surface (lower surface in FIG. 5) of the cartridge 7 that faces the print target surface (surface of the nail). In the ink ejection surface 711, ejection ports (ink ejection ports, not shown in the drawings) of nozzle arrays are formed in row(s). Each nozzle array is configured by including a plurality of nozzles from which an ink of each color is ejected.

The cartridge 7 is configured to perform printing by appropriately ejecting a predetermined ink from an ink ejection port by controlling the print head mechanism 71 by a print controller 113 (refer to FIG. 10) to be described later.

The ink storages are provided so as to correspond to, for example, the inks of yellow (Y), magenta (M), and cyan (C). The ink that can be ejected by the cartridge 7 is not limited to the example shown here, and ink storages that store inks of other colors may be provided.

As shown in FIG. 5, a cartridge terminal portion 73 is provided on the surface which is the back side (rear side in FIG. 5) of the nail printing device 1 when the cartridge 7 is mounted in the cartridge holder 8.

The cartridge terminal portion 73 is a terminal board that is electrically connected to a holder terminal portion 86 by contacting the holder terminal portion 86 of the cartridge holder 8, and that has a plurality of terminals of the cartridge 7 for receiving a drive signal to the print head mechanism 71 of the cartridge 7.

On the upper surface of the cartridge 7, a first protruding portion 722 extends in the width direction of the cartridge 7 (direction orthogonal to the mounting direction indicated by the white arrow in FIG. 7) to be located at a position on the front side (front side in FIG. 5) when the cartridge 7 is mounted. The first protruding portion 722 is provided over substantially the entire width of the cartridge 7.

In the illustration of FIG. 5, for example, the first protruding portion 722 is divided into two having a gap in the center in the width direction. However, as long as the first protruding portion 722 is arranged at least at both ends in the width direction of the cartridge 7, the first protruding portion 722 may not be divided, or may be divided into three or more.

As will be described later, ribs 824 (indicated by a broken line in FIGS. 7 to 9) are formed on the inner side of the upper portion of the cartridge holder 8 so as to protrude inward. When the user attempts to correctly mount the cartridge 7 in the cartridge holder 8 from the back side (rear side in FIG. 5), as shown in FIG. 7, the first protruding portion 722 does not abut against the ribs 824 when the cartridge 7 is pushed in the mounting direction (direction shown by a white arrow in FIG. 7). Thus, as shown in FIG. 8, the cartridge 7 can be pushed deep into the cartridge holder 8.

Figure 9:
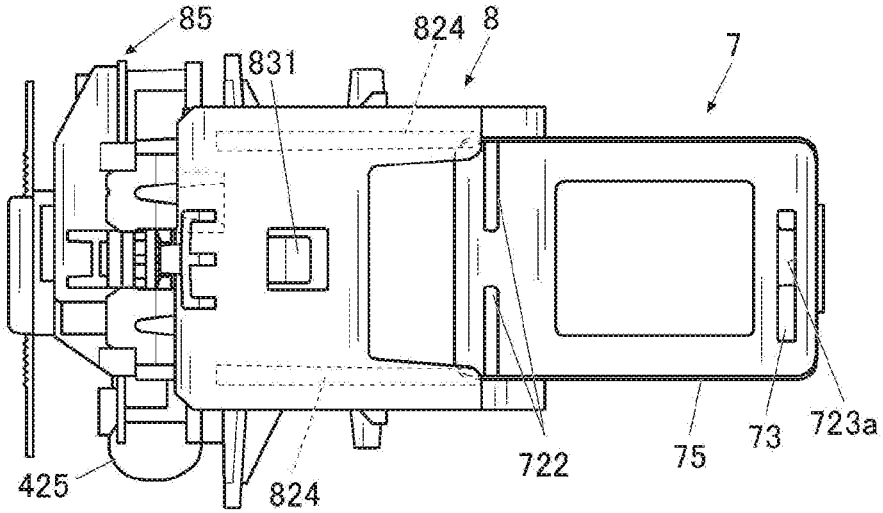
FIG. 9 is a plan view of a state in which the cartridge is being mounted in the cartridge holder in the reverse direction as viewed from above.

On the other hand, when the cartridge 7 is erroneously mounted in the cartridge holder 8 from the front side (front side in FIG. 5) (that is, when the cartridge 7 is reversely inserted), as shown in FIG. 9, the first protruding portion 722 is caught on the rib 824. Thus, the cartridge 7 cannot be pushed deep into the cartridge holder 8.

In such a way, in the present embodiment, when the cartridge 7 is going to be mounted from the front side (front side in FIG. 5), the cartridge 7 cannot be pushed deep into the cartridge holder 8. Thereby, erroneous mounting (reverse insertion) of the cartridge 7 is surely prevented.

Further, at the position on the upper surface of the cartridge 7 which is located on the back side (rear side in FIG. 5) when the cartridge 7 is mounted, a second protruding portion 723 is provided at the substantially central portion in the width direction of the cartridge 7 (direction orthogonal to the mounting direction). At least a part of the back (rear) surface at the upper portion of the second protruding portion 723 is an inclined surface 723*a* including an inclination or a round corner.

As will be described later, a cartridge locking portion 831 is provided inside the upper surface of the cartridge holder 8 that holds the cartridge 7.

The cartridge locking portion 831 is a plate spring or the like having a spring property. When the cartridge 7 is mounted, the cartridge locking portion 831 abuts against the inclined surface 723*a* from the back side of the second protruding portion 723, and gets over the inclination to be fitted on the front side of the second protruding portion 723. As a result, the cartridge 7 is locked to the cartridge holder 8. At this time, the user who mounts the cartridge 7 can feel a click feeling and can intuitively recognize that the cartridge 7 has been normally pushed to a predetermined position.

The second protruding portion 723 is only required to be arranged in a range not interfering with the ribs 824 of the cartridge holder 8 and to be locked with the cartridge locking portion 831. The shape, specific arrangement, and the like of the second protruding portion 723 are not limited to the illustrated example.

In the present embodiment, the outer peripheral portion of the upper surface of the cartridge 7 is a flange portion 75 protruding outward.

The flange portion 75 extends to the width of the ribs 824 of the cartridge holder 8. When the cartridge 7 is mounted in the cartridge holder 8, the upper surface of the flange portion 75 abuts against the lower surfaces 825 of the ribs 824, and the height position of the cartridge 7 (upper surface 721 of the cartridge 7) is regulated not to rise above the ribs 824.

The guide convex portions 751 are formed on the lower surface of the flange portion 75. The shape and number of the guide convex portions 751 are not particularly limited. However, in the present embodiment, two guide convex portions 751 on the back and front sides in the mounting direction are provided on each of the left and right sides of the cartridge 7.

The cartridge holder 8 holds the cartridge 7 so as to be attachable, detachable and replaceable.

The cartridge 7 is mounted in the cartridge holder 8 when the user presses the cartridge 7 along the moving direction of the cartridge holder 8 by the head moving mechanism 49.

In the nail printing device 1 according to the present embodiment, the removal port 213 of the cartridge 7 is formed on the front surface side of the nail printing device 1. Thus, when the cartridge 7 is to be attached, detached or replaced, the cartridge 7 is mounted in the cartridge holder 8 by pressing the cartridge 7 from the front surface side of the nail printing device 1.

As shown in FIG. 6, the cartridge holder 8 of the present embodiment is formed in a substantially rectangular box shape, and is open on the front side and the lower side of the nail printing device 1.

The back side (rear side) of the cartridge holder 8 is a rear surface portion 81, lateral surface portions 82 are arranged on both sides of the rear surface portion 81, and an upper surface portion 83 is arranged on the upper side.

In the present embodiment, a holder terminal portion 86 is provided on the surface on the back side in the mounting direction of the cartridge 7 (that is, the rear surface portion 81) inside the cartridge holder 8.

The holder terminal portion 86 is a terminal board on which a plurality of terminals of the cartridge holder 8 for transmitting a drive signal to the print head mechanism 71 of the cartridge 7 are arranged.

The holder terminal portion 86 is electrically connected to the cartridge terminal portion 73 of the cartridge 7 when the cartridge 7 is mounted in the cartridge holder 8.

The holder support member 85 is provided on the outer surface of the rear surface portion 81 of the cartridge holder 8. The cartridge holder 8 is supported by the X-direction moving stage 45 by inserting the guide shaft 455 through the holder support member 85.

The holder support member 85 is provided with a flexible wiring board 425 which has one end electrically connected to the holder terminal portion 86 (refer to FIGS. 4 and 7 to 9).

The other end side of the wiring board 425 is connected to a substrate in the device main body (not shown in the drawings), and a drive signal sent from the device main body is transferred to the print head mechanism 71 of the cartridge 7 via the holder terminal portion 86 and the cartridge terminal portion 73 connected thereto.

In the inner lower portion of the cartridge holder 8, the distance between the left and right lateral surface portions 82 is narrower than the width of the flange portion 75 of the cartridge 7. On the other hand, the inner upper portion of the cartridge holder 8 is a wide portion 821 in which the interval between the left and right lateral surface portions 82 is wider than the width of the flange portion 75 of the cartridge 7.

In the present embodiment, steps are formed between the lower portion and the upper portion (that is, the wide portion 821) of the cartridge holder 8, and the upper surfaces of the steps (hereinafter referred to as stepped upper surfaces 822) function as guides that guide the cartridge 7 from the front side toward the rear side of the nail printing device 1 when the cartridge 7 is mounted.

The stepped upper surfaces 822 contact the lower side of the flange portion 75 (in the present embodiment, the lower surface of the flange portion 75 or the guide convex portions 751 provided on the lower surface), and guide the cartridge 7 from the lower side.

Thereby, when the cartridge 7 is mounted, the cartridge 7 can smoothly move in the cartridge holder 8 from the front side of the nail printing device 1 toward the rear side (back side) of the nail printing device 1.

Further, the device rear side (back side) portions of the stepped upper surfaces 822 in the present embodiment are step portions 822*a* that are lower than the device front side portions.

The lower surface of the flange portion 75 of the cartridge 7 or the guide convex portions 751 provided on the lower surface moves to the rear side (back side) of the nail printing device 1 while contacting the stepped upper surfaces 822. When the back side (rear side in FIG. 5) of the cartridge 7 reaches the step portions 822*a*, the height position on the back side (rear side in FIG. 5) of the cartridge 7 is greatly lowered.

Thus, for example, even when the cartridge 7 is inserted into the cartridge holder 8 from an obliquely downward direction in a state in which the cartridge 7 is inclined forward and downward (that is, the back side of the cartridge 7 is raised upward), at the portion reaching the step portions 822*a*, the cartridge 7 is rotated in a direction in which the back side of the cartridge 7 is lowered, and the mounting posture can be corrected so as to be substantially horizontal with respect to the cartridge holder 8.

Within the wide portion 821 and above the stepped upper surfaces 822, ribs 824 that protrude inside the cartridge holder 8 extend substantially horizontally from the front side toward the rear side of the lateral surface portions 82 of the nail printing device 1.

The ribs 824 protrude to the inner side than the position of the flange portion 75 when the cartridge 7 is mounted in the cartridge holder 8. In other words, the ribs 824 are arranged so as to cover the lateral ends of the upper surface of the flange portion 75 when the cartridge 7 is mounted in the cartridge holder 8. Thus, the cartridge 7 can only rise to a position where the upper surface of the flange portion 75 contacts the lower surfaces 825 of the ribs 824, and the upper limit position of the upper surface of the cartridge 7 is regulated.

Thus, in the present embodiment, when the cartridge 7 is mounted in the cartridge holder 8, the mounting path is defined so that the flange portion 75 moves within the wide portion 821 between the stepped upper surfaces 822 and the ribs 824.

As a result, the cartridge 7 can be easily mounted at a predetermined position in the cartridge holder 8 even when the user does not confirm the mounting position strictly.

Further, as described above, the ribs 824 protrude to the inner side than the position where the first protruding portion 722 is provided.

Thus, when the cartridge 7 is to be mounted in the cartridge holder 8 from the side where the first protruding portion 722 is provided (that is, the front side of the cartridge 7, the front side in FIG. 5), the first protruding portion 722 abuts against the left and right ribs 824.

Thus, as shown in FIG. 9, the cartridge 7 cannot be pushed deep into the cartridge holder 8, and the reverse insertion of mounting the cartridge 7 in the wrong direction is prevented.

In addition, an elastic cartridge locking portion 831 is provided on the lower surface of the upper surface portion 83 of the cartridge holder 8 (inner surface of the cartridge holder 8).

The cartridge locking portion 831 is a plate spring formed by bending a metal plate, for example.

The cartridge locking portion 831 is arranged to correspond to the portion where the inclined surface 723*a* of the second protruding portion 723 is provided. When the cartridge 7 is mounted in the cartridge holder 8, the cartridge locking portion 831 comes into contact with the second protruding portion 723 from the back side (rear side in FIG. 5), gets over the inclined surface 723*a* and is locked to the front side (front side in FIG. 5) of the second protruding portion 723.

At this time, the user who mounts the cartridge 7 can feel the feeling of the cartridge locking portion 831 going over the second protruding portion 723 as a click feeling, and can intuitively recognize that the cartridge 7 is correctly mounted.

Although not shown in FIG. 6 or other figures, the cartridge holder 8 is provided with a U-shaped stopper member 84 as shown in FIGS. 3 and 4.

The stopper member 84 has a rear end portion fixed to the left and right lateral surface portions 82 of the cartridge holder 8, respectively, and rotates around the fixed portion as a fulcrum.

The stopper member 84 is lifted upward when the cartridge 7 is not mounted, and opens the front side of the cartridge holder 8.

When the cartridge 7 is mounted in the cartridge holder 8, the stopper member 84 is arranged on the front side of the cartridge 7, and prevents the cartridge 7 from falling off the cartridge holder 8 due to external impact or vibration.

The stopper member 84 may be configured to automatically descend to the front side of the cartridge 7 when the cartridge 7 is mounted in the cartridge holder 8, or the user may manually move the stopper member 84 up and down.

The cartridge holder 8 includes lower support portions 87 that support the lower portion of the cartridge 7.

The lower support portions 87 are provided at the lower ends of the left and right lateral surface portions 82, respectively, so as to protrude toward the inside of the cartridge holder 8.

In the present embodiment, since the lower support portions 87 are provided, when the cartridge 7 is mounted, the user can easily confirm the lower end of the mounting position and easily mount the cartridge 7 in the cartridge holder 8.

Next, the control configuration of the nail printing device 1 and the terminal device 9 that cooperates with the nail printing device 1 in the present embodiment will be described with reference to FIG. 10.

Figure 10:
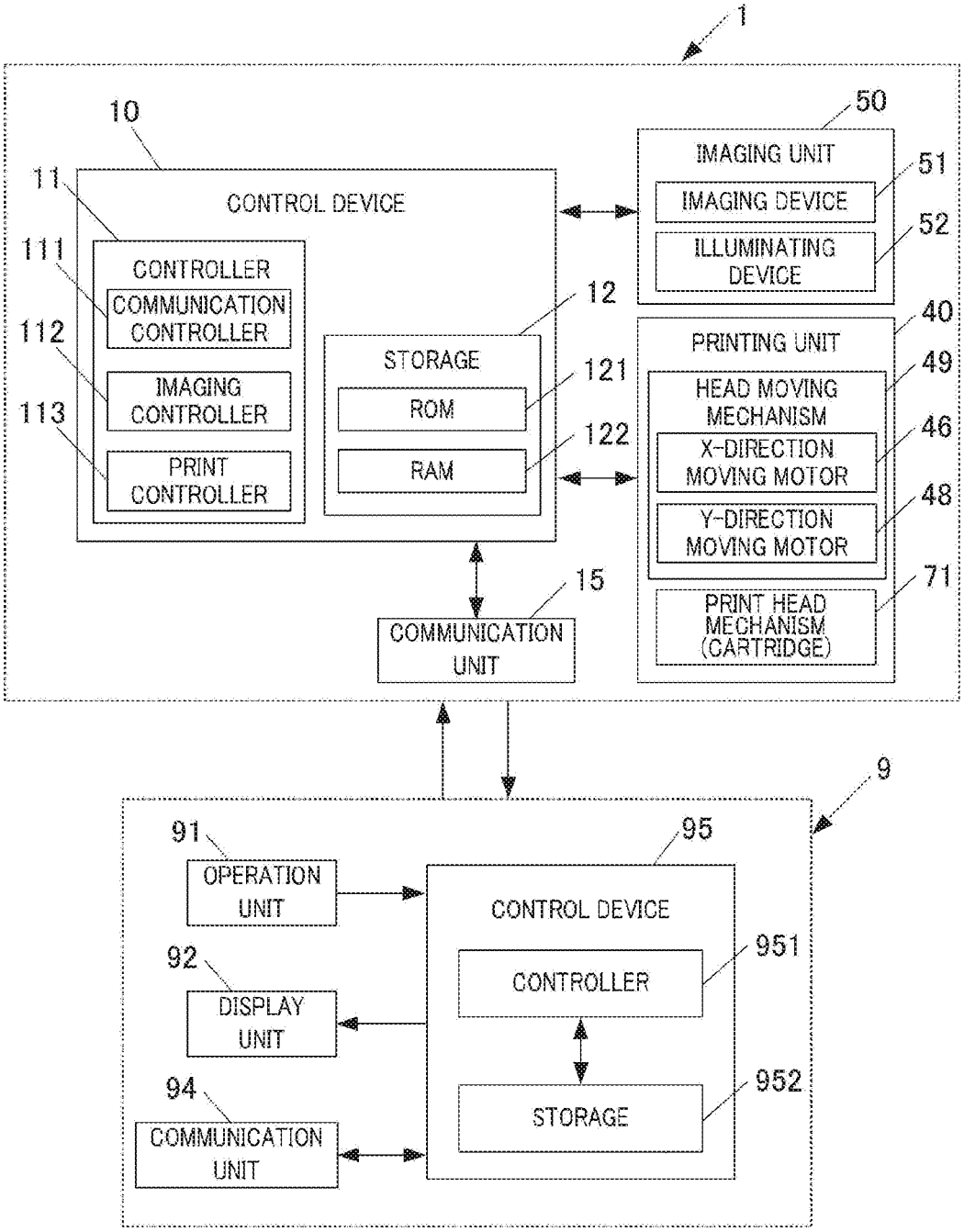
FIG. 10 is a main part block diagram showing a control configuration in the embodiment.

FIG. 10 is a control block diagram illustrating a schematic control configuration of the nail printing device 1 and the terminal device 9.

As shown in FIG. 10, the nail printing device 1 according to the present embodiment cooperates with the terminal device 9 and operates in accordance with an instruction input from the terminal device 9.

The nail printing device 1 includes an imaging unit 50, a communication unit 15, and a control device 10 in addition to the printing unit 40 described above.

The imaging unit 50 includes an imaging device 51 and an illuminating device 52.

The imaging unit 50 illuminates the nail of the printing finger placed on the finger fixing unit 6 with the illuminating device 52. Then, the imaging device 51 is used to capture an image of the printing finger to obtain a nail image (an image of the nail including the printing finger) that is an image of the nail of the printing finger.

The imaging unit 50 may be configured to be movable in the X and Y directions by a head moving mechanism 49 that moves the cartridge 7.

The imaging device 51 is, for example, a small-sized camera configured by including a solid state image sensor which has approximately two million pixels or more and a lens. The illuminating device 52 is an illuminating lamp, such as a white LED.

The imaging unit 50 is connected to an imaging controller 112 of a control device 10 described below, and the operation of the imaging unit 50 is controlled by the imaging controller 112.

The image data acquired by the imaging unit 50 is transmitted as needed to a terminal device 9 to be described later. The image data may be stored in a storage 12 or the like to be described later.

The communication unit 15 is configured to be able to transmit and receive information to and from the terminal device 9.

The communication between the nail printing device 1 and the terminal device 9 is performed by, for example, a wireless LAN. The communication between the nail printing device 1 and the terminal device 9 is not limited to this, and any method may be used. For example, a network line such as the Internet may be used, or wireless communication based on a near field communication standard such as Bluetooth (registered trademark) or Wi-Fi may be performed. Further, this communication is not limited to wireless communication, and various types of data may be transmitted and received between the nail printing device 1 and the terminal device 9 by wired connection. The communication unit 15 includes an antenna chip or the like corresponding to the communication method of the terminal device 9.

The control device 10 is installed on a not-shown circuit board or the like arranged on the lower surface side or the like of the top surface of the housing 2, for example.

The control device 10 is a computer that includes: a controller 11 configured by including a CPU (Central Processing Unit) (not shown in the drawings); and a storage 12 configured by including a ROM (Read Only Memory) 121, a RAM (Random Access Memory) 122, and the like.

The storage 12 stores various programs and various data for operating the nail printing device 1.

Specifically, the ROM 121 of the storage 12 stores various programs such as a program for performing an imaging process and a printing program for performing a printing process, and these programs are executed by the control device 10. Thus, each part of the nail printing device 1 is controlled in an integrated manner.

The controller 11 includes a communication controller 111, an imaging controller 112, a print controller 113, and the like when viewed functionally. The functions as the communication controller 111, the imaging controller 112, the print controller 113, and the like are realized by the cooperation of the CPU of the controller 11 and the program stored in the ROM 121 of the storage 12.

The communication controller 111 controls the operation of the communication unit 15. In the present embodiment, communication with a terminal device 9 to be described later is controlled, and when data for printing or the like is transmitted from the terminal device 9, this data is received.

When the nail image is acquired by the imaging unit 50, the nail image data is transmitted to the terminal device 9.

The imaging controller 112 controls the imaging device 51 and the illuminating device 52 of the imaging unit 50, and uses the imaging device 51 to capture a finger image (nail image) including an image of a nail of a printing finger fixed to the finger fixing unit 6.

The image data of the nail image acquired by the imaging unit 50 is transmitted to the terminal device 9 via the communication unit 15. The image data may be stored in the storage 12 or the like.

The print controller 113 is a controller that outputs a control signal to the printing unit 40 based on the data for printing transmitted from the terminal device 9, and controls the head moving mechanism 49 (X-direction moving motor 46 and the Y-direction moving motor 48 included in the head moving mechanism 49), the print head mechanism 71 of the cartridge 7, and the like of the printing unit 40 so as to perform printing according to the data for printing on the nail.

In the present embodiment, the print controller 113 functions as a motor control circuit that controls the operation of the drive motor (that is, the X-direction moving motor 46 and the Y-direction moving motor 48) included in the head moving mechanism 49 so as to move the cartridge holder 8 that holds the cartridge 7 to a predetermined replacement area Ar3 (refer to FIG. 4) when the cartridge 7 needs to be attached or detached.

Here, the function of the print controller 113 as a motor control circuit will be described in detail with reference to FIGS. 11, 12A, and 12B.

In the present embodiment, in the initial state in which the power of the nail printing device 1 is OFF, the cartridge holder 8 is arranged at the home position Ar1 (refer to FIG. 4) which is a standby position.

When the power of the nail printing device 1 is turned on according to the operation instruction from the terminal device 9, the print controller 113 moves the cartridge holder 8 from the home position Ar1 to the replacement area Ar3.

Specifically, the Y-direction moving motor 48 is controlled to move the cartridge holder 8 (X-direction moving stage 45 supporting the cartridge holder 8) straight along the Y direction to the front surface side of the nail printing device 1, and to stop the cartridge holder 8 in the replacement area Ar3 close to the removal port 213.

The home position Ar1 is provided with a cap mechanism (not shown in the drawings) that protects the ink ejection surface 711 of the cartridge 7 from drying and the like. When the cartridge 7 is currently mounted in the cartridge holder 8 and is to be replaced, the cartridge holder 8 is arranged at the home position Ar1.

However, when the cartridge 7 is out of the cartridge holder 8, for example, when the nail printing device 1 is not used for a long period of time, the cartridge holder 8 is not necessarily arranged at the home position Ar1. In addition, the power may be turned off in a state in which the cartridge holder 8 is arranged at a position different from the home position Ar1.

In such a configuration, the print controller 113 grasps the current position of the cartridge holder 8, and appropriately controls the X-direction moving motor 46 and the Y-direction moving motor 48 to move the cartridge holder 8 in the X direction and the Y direction, move the cartridge holder 8 to the replacement area Ar3, and then stop the cartridge holder 8.

The print controller 113 as a motor control circuit controls the operation of the drive motor (that is, the X-direction moving motor 46 and the Y-direction moving motor 48) so that the cartridge holder 8 does not move in the moving direction by applying a predetermined voltage or a current to the X-direction moving motor 46 and the Y-direction moving motor 48 that are drive motors when the cartridge 7 is mounted in the cartridge holder 8.

In the present embodiment, when the print controller 113 stops the cartridge holder 8 in the replacement area Ar3, the print controller 113 holds the stopped state by applying a predetermined voltage or a current to the drive motor (X-direction moving motor 46 or the Y-direction moving motor 48) so as not to move the cartridge holder 8 from the current position.

As described above, the cartridge 7 is mounted in the cartridge holder 8 by the user pressing the cartridge 7 along the moving direction of the cartridge holder 8. In the present embodiment, the cartridge 7 is mounted in the cartridge holder 8 by the user pressing the cartridge 7 toward the rear side in the Y direction from the front side of the nail printing device 1 to the cartridge holder 8 which is stationary (standing still) in the replacement area Ar3.

Thus, when the Y-direction moving motor 48, which is a drive motor, is turned off into a free state, the cartridge holder 8 goes back in the pressing direction when the user presses the cartridge 7, and thus the cartridge 7 cannot be mounted.

On the other hand, when the cartridge holder 8 is completely fixed mechanically or electrically so that the cartridge holder 8 does not move, a part(s) in the nail printing device 1 may be damaged when an excessively strong force is applied.

In particular, when the voltage or current applied to the drive motor (in the present embodiment, the Y-direction moving motor 48) is increased to completely maintain the stationary state of the cartridge holder 8, for example, the drive motor (Y-direction moving motor 48) and the surrounding various mechanisms may be damaged, for example, the belts (drive belts 474) connected to the drive motor (Y-direction moving motor 48) may be damaged to cause tooth skipping, the belts (drive belts 474) may be broken, and the shaft portions (guide shafts 475) may be damaged.

Therefore, in the present embodiment, when the absolute value of the minimum force (external force) required to mount the cartridge 7 in the cartridge holder 8 is P, the absolute value of the force (resisting force against the external force, resisting force in the direction facing the external force) that can hold the cartridge holder 8 in a stationary state is Q and the absolute value of the force that may damage the moving mechanism is R, the print controller 113 serving as the motor control circuit controls the voltage or current applied to the drive motor (that is, the Y-direction moving motor 48) to satisfy $P<Q<R$.

Figure 11:
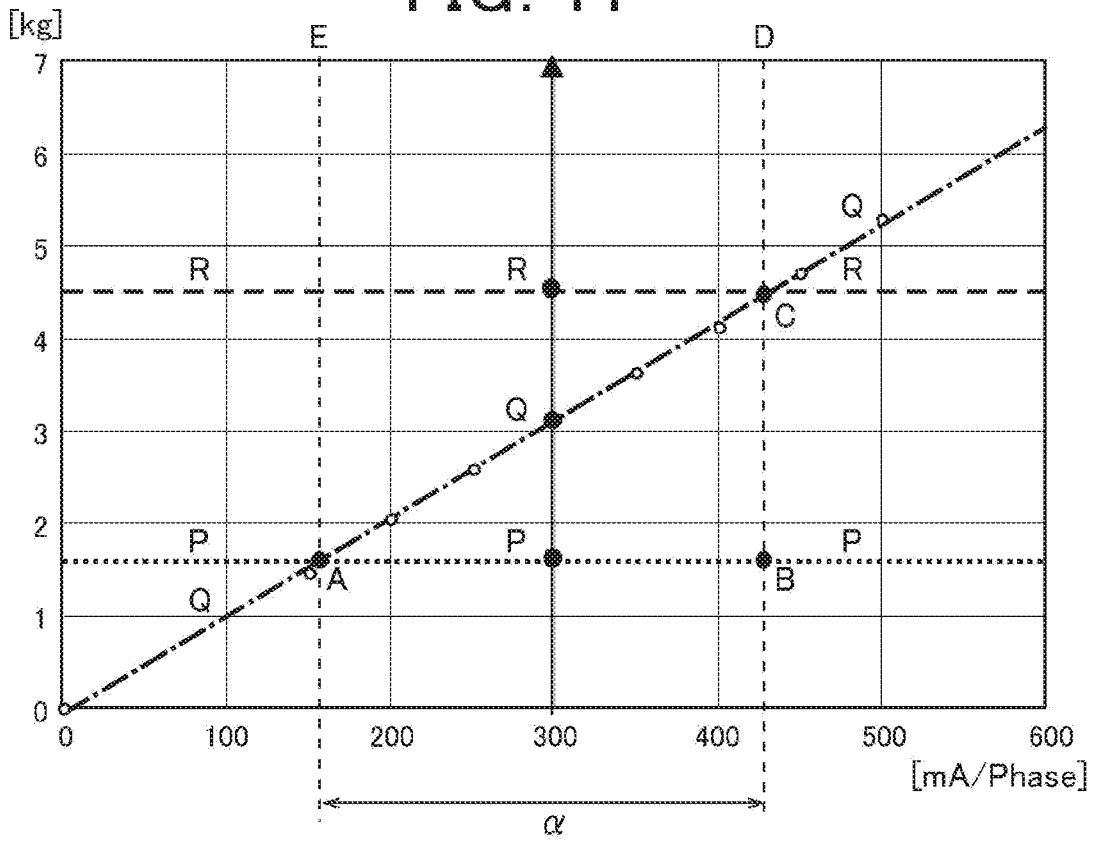
FIG. 11 is a graph for explaining control of a head moving mechanism in the embodiment.

FIG. 11 is a graph for explaining the control of the head moving mechanism in the present embodiment.

In FIG. 11, the horizontal axis represents the applied current value (unit: [mA/Phase]) which is applied to one phase of the drive motor (Y-direction moving motor 48) in order to hold the cartridge holder 8 in a stationary state, and the vertical axis represents the force applied to the cartridge holder 8 (unit: [kg]).

In FIG. 11, a horizontal line indicated by a dotted line (horizontal line in the lower section of the graph) represents the minimum force P required to mount the cartridge 7 in the cartridge holder 8. FIG. 11 shows an example in which P is approximately 1.6 kg. In FIG. 11, a horizontal line (horizontal line in the upper section of the graph) indicated by a broken line indicates a force that may cause tooth skipping of the belt (drive belt 474) (force R that may damage the moving mechanism). FIG. 11 shows an example in which the force R is approximately 4.5 kg. In FIG. 11, an oblique line indicated by a one-dot chain line indicates a force Q that can hold the cartridge holder 8 in a stationary state.

As the applied current applied to the drive motor (Y-direction moving motor 48) increases, the force that can keep the cartridge holder 8 stationary against the external force increases.

In this regard, when the user pushes the cartridge 7 into the cartridge holder 8, when the user's force to push the cartridge 7 is weak, even when the applied current applied to the drive motor (Y-direction moving motor 48) is small, the forces balance. Thus, the cartridge holder 8 can be kept stationary.

However, in order to mount the cartridge 7 in the cartridge holder 8, it is necessary to push the cartridge 7 with a strong force of a certain degree.

Figure 12A:
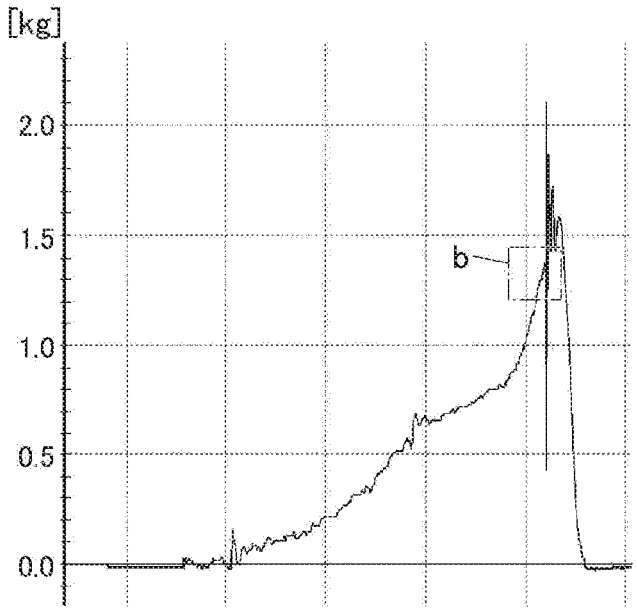
FIG. 12A is a graph for explaining a force for mounting the cartridge in the cartridge holder.
Figure 12B:
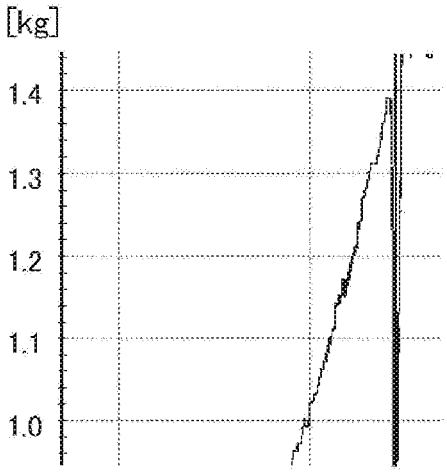
FIG. 12B is an enlarged view of a portion b surrounded by a dashed line in FIG. 12A.

FIG. 12A is a graph for explaining the force for mounting the cartridge in the cartridge holder, and FIG. 12B is an enlarged view of a portion b surrounded by a one-dot chain line in FIG. 12A.

The minimum force (external force) required to mount the cartridge 7 in the cartridge holder 8 depends on slight differences in the manufacturing stage and assembly stage of the cartridge 7 and the cartridge holder 8. FIG. 11 shows an example in which the mounting is completed when the cartridge 7 is pressed with a force of 1.6 kg or more. FIGS. 12A and 12B show an example in which the cartridge 7 is mounted in the cartridge holder 8 with the pressing force of approximately 1.4 kg.

In the present embodiment, after the cartridge 7 is mounted, the cartridge locking portion 831 gets over the inclined surface 723*a* from the back side of the second protruding portion 723 as described above, and fitted on the front side of the second protruding portion 723, thus generating a click feeling. By such a configuration generating the click feeling, in the example shown in FIGS. 12A and 12B, the force moves up and down violently for a moment after exceeding 1.4 kg, and then descends at a stroke.

In order to mount the cartridge 7, as described above, the force Q that can hold the cartridge holder 8 in a stationary state must be larger than the minimum force P required to mount the cartridge 7 in the cartridge holder 8.

In the example shown in FIG. 11, the force Q exceeds the force P when a current of approximately 160 [mA/Phase] or more is applied to the drive motor (Y-direction moving motor 48).

In addition, the force Q exceeds the force R that may damage the moving mechanism when a current of approximately 420 [mA/Phase] or more is applied to the drive motor (Y-direction moving motor 48).

Thus, in the example shown in FIG. 11, the print controller 113 which is a motor control circuit performs control to apply, to the drive motor (that is, the Y-direction moving motor 48), the current within the range of approximately 160 [mA/Phase] to 420 [mA/Phase] (in the range indicated by a in FIG. 11) as a current that satisfies P<Q<R.

By controlling as described above, when a current within the range indicated by a is applied to the drive motor (Y-direction moving motor 48), the cartridge 7 can be mounted with the cartridge holder 8 remaining stationary, for the range surrounded by the triangle ABC, that is, when the absolute value of the force applied to the cartridge holder 8 by the user pressing the cartridge 7 is smaller than the force Q. Also, for the range surrounded by the trapezoid ACDE, that is, when the absolute value of the force applied to the cartridge holder 8 by the user pressing the cartridge 7 is larger than the force Q, the cartridge 7 can be mounted though the cartridge holder 8 slightly moves in the moving direction (in the present embodiment, the Y direction).

The current value or voltage value to be applied to the drive motor (Y-direction moving motor 48) in order to satisfy P<Q<R can change depending on various conditions such as the configurations of the cartridge 7 and the cartridge holder 8 and the device rigidity.

Thus, the values shown in FIG. 11 are merely examples, and appropriate values are set at the design stage of each device as needed.

As the terminal device 9, for example, a mobile terminal device such as a smartphone or a tablet is assumed. However, the terminal device 9 is not limited to this. The terminal device 9 is not particularly limited as long as the terminal device 9 can communicate with the nail printing device 1. For example, the terminal device 9 may be a notebook or a stationary personal computer, a terminal device for a game, or the like.

Specifically, the terminal device 9 includes an operation unit 91, a display unit 92, a communication unit 94, a control device 95, and the like.

The operation unit 91 can perform various inputs and settings according to user operations. When the operation unit 91 is operated, an input signal corresponding to the operation is transmitted to the control device 95. In the present embodiment, a touch panel is integrally provided on the surface of the display unit 92, and the user can perform various input/setting operations by touch operations on the touch panel.

The operation unit 91 for performing various input/setting operations is not limited to the touch panel. For example, various operation buttons, a keyboard, a pointing device, and the like may be provided as the operation unit 91.

In the present embodiment, the user can select a nail design to be printed on the nail by operating the operation unit 91.

The touch panel configured in the display unit 92 displays various display screens under the control of a controller 951 to be described later.

In the present embodiment, the display unit 92 can display a nail design which was input or selected by the user from the operation unit 91, an image which was transmitted from the nail printing device 1, and the like.

The communication unit 94 can transmit data for printing to the nail printing device 1. Further, when data such as a nail image is transmitted from the nail printing device 1, the communication unit 94 receives the transmitted data. The communication unit 94 includes a wireless communication module that can communicate with the communication unit 15 of the nail printing device 1.

The communication unit 94 only needs to be able to communicate with the nail printing device 1, and a communication unit that matches the communication standard of the communication unit 15 of the nail printing device 1 is applied as the communication unit 94.

The control device 95 is a computer that includes: a controller 951 configured by including a CPU (Central Processing Unit) not shown in the drawings; and a storage 952 configured by including a ROM (Read Only Memory) and a RAM (Random Access Memory) not shown in the drawings.

The storage 952 stores various data and various programs for operating each part of the terminal device 9.

Specifically, the ROM or the like of the present embodiment stores various programs (none of them shown in the drawings) such as a nail print application program for performing nail printing using the nail printing device 1 in addition to an operation program for controlling each part of the terminal device 9 in an integrated manner. The control device 95 expands and executes these programs in a work area of the RAM, for example, so that the terminal device 9 is controlled.

The storage 952 of the present embodiment stores nail design data, nail image data, nail position/range information, and the like.

The controller 951 controls the operation of each part of the terminal device 9 in an integrated manner. The controller 951 implements various functions for performing printing on the nail in cooperation with a program stored in the storage 952.

Hereinafter, the operation of the nail printing device 1 when the cartridge 7 is mounted in the present embodiment will be described.

When the cartridge 7 of the nail printing device 1 is to be replaced, first, the user inputs an instruction to replace the cartridge 7 of the nail printing device 1 from the terminal device 9. Thus, when the power of the nail printing device 1 is OFF, the terminal device 9 outputs a power ON instruction to the nail printing device 1 and the nail printing device 1 is activated.

When the nail printing device 1 is activated, the print controller 113 controls the drive motor (that is, the X-direction moving motor 46 and the Y-direction moving motor 48 included in the head moving mechanism 49), and moves the cartridge holder 8 to the replacement area Ar3 corresponding to the removal port 213.

For example, when the cartridge holder 8 is located at the home position Ar1 on the right rear side of the base 3 in the initial state in which the power is OFF, the print controller 113 controls the Y-direction moving motor 48 to move the cartridge holder 8 forward along the Y direction (direction indicated by the black arrow in FIG. 4) to the front side of the nail printing device 1 and move the cartridge holder 8 to the replacement area Ar3.

At this time, a message such as "Open the upper cover of the nail printing device and mount the cartridge" may be displayed on the display unit (not shown in the drawings) of the terminal device 9.

Figure 13:
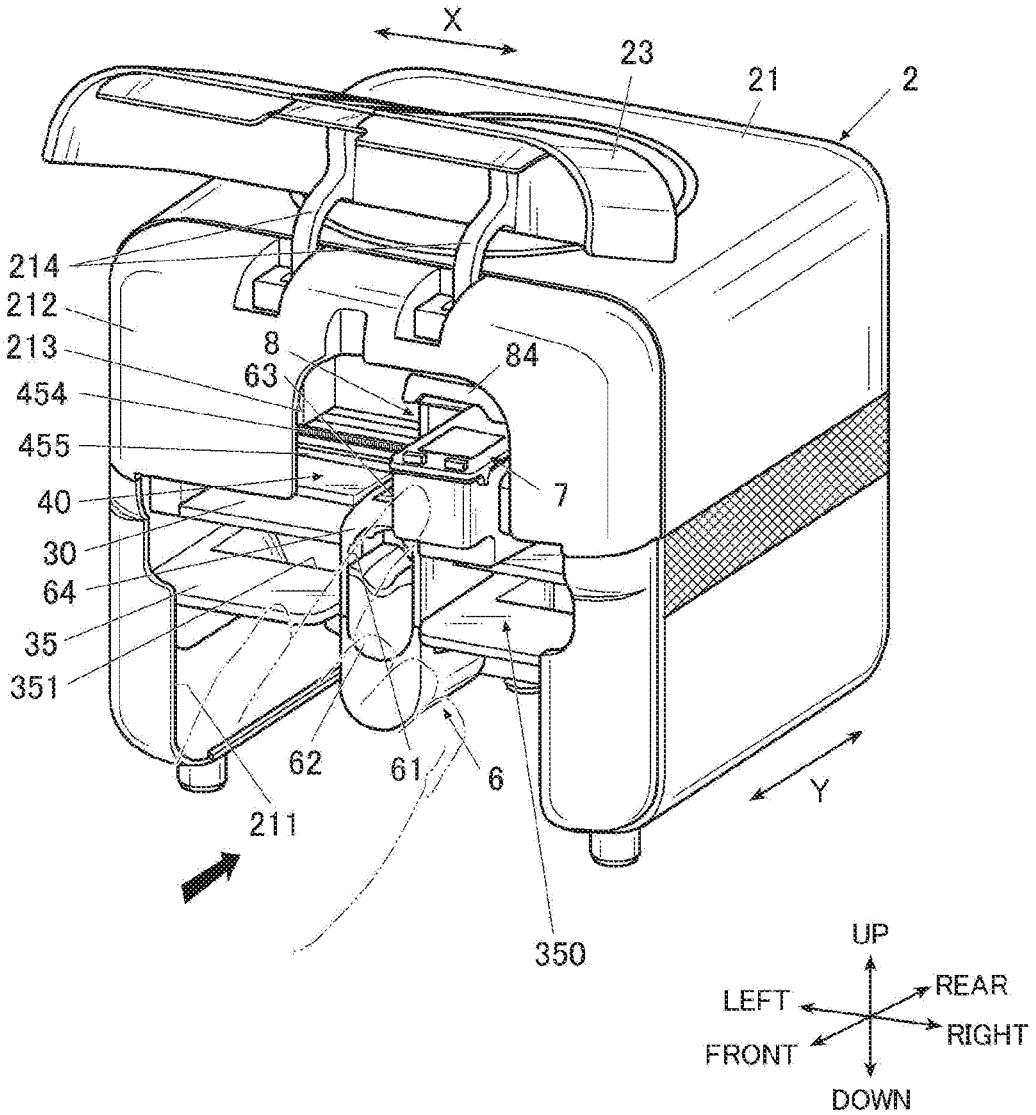
FIG. 13 is a perspective view showing a state in which the cartridge is being mounted in the cartridge holder in the nail printing device in the state shown in FIG. 3.

When the cartridge holder 8 moves to the replacement area Ar3, the user opens the upper cover 23 after removing the lower cover 22 from the housing body 21. When the stopper member 84 of the cartridge holder 8 is lowered, the user raises the stopper member 84 to open the cartridge holder 8. Then, as shown in FIG. 13, the cartridge 7 is mounted in the opened cartridge holder 8 from the front side. In FIG. 13, user's hand for pushing the cartridge 7 is indicated by a two-dot chain line. In FIG. 13, the pressing direction when the user pushes in the cartridge 7 is indicated by a black arrow.

Specifically, the cartridge 7 is inserted to be pushed in from the diagonally downward direction of the front side of the cartridge holder 8 toward the diagonally upward direction so as to locate the cartridge terminal portion 73 on the back side.

At this time, the print controller 113 applies a predetermined current or voltage to the drive motor (Y-direction moving motor 48) so as to satisfy the condition of $P<Q<R$.

As a result, the drive motor (Y-direction moving motor 48) is in a braked state, and the cartridge holder 8 is held stationary against the pressing force of the user (force indicated by the white arrow in FIGS. 7 and 13). Thus, the user can mount the cartridge 7 easily.

By the user pushing the cartridge 7 to the back of the cartridge holder 8, the holder terminal portion 86 and the cartridge terminal portion 73 are electrically connected.

Further, when the cartridge 7 is pushed to the back of the cartridge holder 8, the cartridge locking portion 831 gets over the second protruding portion 723 of the cartridge 7 and is locked to the second protruding portion 723. At this time, the user can feel a click feeling that the cartridge locking portion 831 which is a plate spring fits into the second protruding portion 723, and intuitively recognizes that the cartridge 7 is correctly mounted.

Thereafter, the user lowers the stopper member 84 toward the front side of the cartridge 7 to prevent the cartridge 7 from falling off unintentionally.

Then, the user closes the upper cover 23, and removes the lower cover 22 and the drawer portion 24 integrated with the lower cover 22 from the nail printing device 1 to expose the finger fixing unit 6 and the finger standby unit 350.

When the cartridge 7 is mounted in the cartridge holder 8, the user selects and sets a nail design that the user desires to print on the nail from the terminal device 9, places the printing finger on the finger fixing unit 6, and places the other non-printing fingers on the finger standby unit 350. Then, by instructing the start of printing from the terminal device 9, the printing operation is performed appropriately, and the desired nail design is printed on the nail of the printing finger.

Preferably, the control device 95 of the terminal device 9 instructs the imaging unit 50 of the nail printing device 1 to capture an image of the printing finger placed on the finger fixing unit 6 before printing is started. When the captured image is transmitted to the terminal device 9, the nail area is detected by analyzing the image (nail image), the nail design is appropriately fitted into the detected area as a print area, various corrections are performed, and then data for printing is generated.

When the data for printing is generated in such a way, the data for printing is output from the terminal device 9 to the nail printing device 1. When the data for printing is transmitted from the terminal device 9, the print controller 113 of the nail printing device 1 outputs the data for printing to the print head mechanism 71 and appropriately controls the head moving mechanism 49 to perform printing on the basis of the data for printing. Thereby, appropriate printing suitable for the user's nail can be performed.

As described above, according to the present embodiment, there are provided: the head moving mechanism 49 including the drive motor (in the present embodiment, the Y-direction moving motor 48) for moving the cartridge holder 8 that holds the cartridge 7 so as to be attachable, detachable and replaceable; and a print controller 113 as a motor control circuit that controls the operation of the Y-direction moving motor 48. The cartridge 7 is mounted in the cartridge holder 8 by being pressed along the moving direction by the head moving mechanism 49. The print controller 113 controls the operation of the Y-direction moving motor 48 so that the cartridge holder 8 does not move in the moving direction (in the present embodiment, Y direction) by applying a predetermined voltage or current to the Y-direction moving motor 48 when the cartridge 7 is mounted in the cartridge holder 8.

Accordingly, the cartridge mounting operation can be performed in the same Y direction (front-rear direction of the nail printing device 1) as the insertion direction in which the printing finger is inserted into the finger fixing unit 6 during printing, and the configuration is easy to intuitively understand for the user.

In such a way, the insertion direction of the printing finger is made same as the mounting direction of the cartridge so that the insertion operation and the mounting operation can be performed from the same surface side (front surface side of the nail printing device 1 in the present embodiment). Thus, it is sufficient to provide an opening on only one surface, and it is sufficient to open only the one surface. Thus, there is no need to provide a plurality of lids and openings on the upper surface, lateral surfaces or the like, and the device configuration can be simplified.

When the user pushes in the cartridge 7 along the moving direction of the cartridge holder 8 at the time of mounting of the cartridge 7 as described above, the cartridge holder 8 needs to be configured to maintain the stationary state against the push by the user. However, by adopting the above configuration, the position of the cartridge holder 8 can be maintained well, and the cartridge 7 can be mounted easily and appropriately.

Thus, it is easy to attach, detach or replace the cartridge 7, and it is possible to realize a nail printing device that can perform good printing.

In the present embodiment, the print controller 113 as the motor control circuit controls a predetermined voltage or current applied to the Y-direction moving motor 48 to satisfy P<Q<R when the absolute value of the minimum force (external force) required to mount the cartridge 7 in the cartridge holder 8 is P, the absolute value of the force (resisting force against the external force) that can hold the cartridge holder 8 in a stationary state is Q and the absolute value of the force that may damage a part(s) such as the drive belt 474 included in the head moving mechanism 49 or the like is R.

Thus, the cartridge 7 can be easily attached, detached and replaced, and an excessive force can be prevented from being applied to each part of the nail printing device 1. It is possible to prevent the tooth skipping and breakage of the drive belt 474, and the damage of each part in the nail printing device 1.

Although an embodiment of the present invention is described above, the present invention is not limited to the embodiment and can be appropriately modified in a variety of aspects without departing from the scope of the present invention.

For example, in the present embodiment, the removal port 213 of the cartridge 7 is provided on the front surface side of the nail printing device 1, and the position moved straight in the Y direction from the home position Ar1 toward the front side of the nail printing device 1 is defined as the replacement area Ar3. However, the positions to provide the removal port 213 and the replacement area Ar3 are not limited to the example shown in the embodiment.

The replacement area Ar3 and the removal port 213 of the cartridge 7 when the cartridge 7 is mounted in the cartridge holder 8 may be provided on a lateral surface of the nail printing device 1.

The moving direction of the cartridge holder 8 by the head moving mechanism 49 may be at least one of the Y-axis direction that is the front-rear direction of the nail printing device 1 and the X-axis direction that is the left-right direction of the nail printing device 1 orthogonal to the Y-axis direction.

The cartridge 7 is mounted in the cartridge holder 8 by being pressed along the moving direction by the head moving mechanism 49. However, when the replacement area Ar3 and the removal port 213 are provided on the lateral side of the nail printing device 1, the cartridge 7 may be mounted in the cartridge holder 8 from the lateral side.

When the cartridge 7 is mounted in the cartridge holder 8 from the lateral side, the moving direction is the X direction which is the left-right direction of the nail printing device 1. Thus, when the cartridge 7 is mounted, the print controller 113 as a motor control circuit controls a predetermined voltage or current applied to the X-direction moving motor 46 included in the head moving mechanism 49. Thereby, the cartridge holder 8 is held in a stationary state, and the user can easily mount the cartridge 7.

As described above, when the mounting direction of the cartridge 7 is either the X direction or the Y direction, the head moving mechanism 49 can easily mount the cartridge 7 by the print controller 113 as a motor control circuit controlling the voltage or current, which is applied to the X-direction moving motor 46 or the Y-direction moving motor 48, to have a predetermined value.

In the present embodiment, when Q is the absolute value of the force that can hold the cartridge holder 8 in a stationary state (resisting force against the external force), the current having Q satisfy the condition of P<Q<R is applied to the drive motor (Y-direction moving motor 48). However, there may be provided a measurement unit that measures the force received by the cartridge holder 8 when the cartridge 7 is pushed in, so that the print controller 113 performs control to change the current to be applied according to the measured force.

By controlling the current in such a way, the cartridge holder 8 can be kept at the position of the replacement area Ar3 by increasing the current applied to the drive motor (that is, the Y-direction moving motor 48) in a degree not exceeding R even when the current initially set to be applied is small.

As a result, it is possible to prevent the drive motor (Y-direction moving motor 48) from being consumed by constantly having a large amount of current flow, and to correctly mount the cartridge 7 in the cartridge holder 8 without moving the cartridge holder 8 from the replacement area Ar3.

In the present embodiment, the cartridge 7 is a head-integrated ink cartridge that is integrated with the print head mechanism 71 of the inkjet type, however the cartridge of the present invention is not limited to the cartridge that performs printing by the inkjet method.

Further, the cartridge is not limited to the head-integrated type. For example, a print head mechanism having a function of ejecting ink may be provided to the cartridge holder 8 in which the cartridge is mounted, and the cartridge may have only an ink storage.

When the cartridge has only an ink storage in such a way, a replaceable cartridge as a consumable can be realized with a simple and inexpensive configuration, which is economical for the user.

Such a cartridge may have a sensor for monitoring the decrease of ink and a terminal portion connected to the sensor so that, when the cartridge is mounted in the cartridge holder, the remaining amount of ink is grasped by the nail printing device 1 via the cartridge terminal portion and the holder terminal portion, and the user is notified of the replacement time of the cartridge.

In addition, when the sensor is provided to monitor the decrease of ink and the detection result by the sensor is transmitted to the terminal device 9, if it is determined that the cartridge replacement time has come by the control device 95 of the terminal device 9 or the like, an operation instruction may be output to the print controller 113 of the nail printing device 1 so as to move the cartridge holder 8 to a replacement area Ar3 and apply a predetermined voltage or current for making the cartridge holder 8 stationary to the drive motor (X-direction moving motor 46 or Y-direction moving motor 48).

In the present embodiment, the nail printing device 1 performs the printing by the inkjet method, however the method by which the nail printing device 1 performs the printing is not limited to the inkjet method.

For example, a pen holder that holds a pen for printing by bringing the pen tip into contact with the surface of the nail may be provided so that printing is performed by using the pen. Moreover, there may be provided both the inkjet type printing unit as in the present embodiment and the pen holder holding the pen for printing, to perform printing by using a plurality of printing units.

In the present embodiment, the nail printing device 1 configures a printing system in cooperation with the terminal device 9, and the terminal device 9 inputs a print start instruction, detects a print area (that is, a nail area), and performs various corrections and generation of data for printing, and the like. Then the printing operation for performing printing on the nail is performed by the nail printing device 1. However, the nail printing device 1 is not limited to the device shown in the present embodiment.

For example, an operation unit and a display unit for inputting various instructions, a printing data generation unit for generating data for printing, and the like may be provided in the nail printing device 1 so that the control device of the nail printing device 1 may perform these processes.

When configured in such a way, the nail printing device 1 can also be configured to complete the printing operation alone without cooperating with the terminal device 9.

The image data of nail design may be provided in any storage of the terminal device 9 or may be stored in any storage of the nail printing device 1.

The image data of nail design may be stored in a server device or the like that can be connected via a network line or the like so that the terminal device 9 or the nail printing device 1 can access the server device or the like to refer to the image data of nail design.

In this way, it is possible to select a design to be printed from among more nail designs.

Further, the nail printing device 1 may be provided with a drying unit including a heater and a fan for drying the ink after printing.

For example, by providing a drying unit in the finger standby unit 350 or the like, the printed nail can be dried during printing on the nail of another finger, and the time required for nail printing can be shortened.

Although several embodiments of the present invention have been described, the scope of the present invention is not limited to the above described embodiments and includes the scope of the present invention that is described in the claims and the equivalents thereof.

What is claimed is:

1. An electronic device comprising:

a cartridge holder that holds a cartridge;

a motor for moving the cartridge holder in a moving direction; and a motor control circuit that controls a movement in the moving direction of the cartridge holder by the motor, wherein the motor control circuit applies a voltage or a current to the motor to apply, to the cartridge holder, a resisting force in a direction facing an external force from a user, against the external force which is applied by the user along the moving direction to the cartridge holder through the cartridge during user mounting of the cartridge in the cartridge holder, wherein the motor control circuit controls the voltage or the current applied to the motor so that an absolute value of the resisting force is larger than an absolute value of the external force that is a predetermined minimum value required for mounting the cartridge in the cartridge holder, and the cartridge holder will not move or will only slightly move in the moving direction when there are predetermined external forces applied by the user to the cartridge holder through the cartridge that are equal to or greater than the predetermined minimum value during user mounting of the cartridge so that the user is able to still mount the cartridge in the cartridge holder despite the slight movement thereof.

2. The electronic device according to claim 1, wherein the moving direction is at least one of an X-axis direction that is a left-right direction of the electronic device and a Y-axis direction that is a front-rear direction of the electronic device, the Y-axis direction being orthogonal to the X-axis direction.

3. The electronic device according to claim 1, wherein the motor control circuit controls the voltage or the current applied to the motor so that an absolute value of the resisting force is smaller than an absolute value of a force having a possibility of damaging a component that causes the cartridge holder to move by pressing the cartridge holder.

4. The electronic device according to claim 1, wherein the motor control circuit controls the voltage or the current applied to the motor so that the voltage or the current has a constant value.

5. The electronic device according to claim 1, wherein the motor control circuit performs control so that a magnitude of the voltage or the current applied to the motor changes according to a magnitude of the external force applied to the cartridge holder through the cartridge.

6. The electronic device according to claim 1, wherein the cartridge includes an ink storage that stores ink for printing on a print target.

7. The electronic device according to claim 1, wherein the cartridge includes an ink ejection surface, and printing is performed on a print target by ejecting ink from the ink ejection surface.

8. The electronic device according to claim 1, wherein the cartridge is a pen for printing, and the cartridge holder is a pen holder that holds the pen.

9. The electronic device according to claim 1, wherein the resisting force is a force that stops the cartridge holder.

10. The electronic device according to claim 1, further comprising a second motor for moving the cartridge holder in a second moving direction orthogonal to the moving direction, wherein the motor control circuit controls a movement in the second moving direction of the cartridge holder by the second motor.

11. The electronic device according to claim 1, further comprising an opening for attaching and detaching of the cartridge on a front surface side of a housing of the electronic device.

12. The electronic device according to claim 1, further comprising a guide that is provided in the cartridge holder to mount the cartridge in the cartridge holder from the moving direction.

13. The electronic device according to claim 1, wherein the motor control circuit applies the voltage or the current to the motor to apply, to the cartridge holder, the resisting force in a second direction facing the external force, against the external force which is applied along a first direction in the moving direction to the cartridge holder through the cartridge so as to mount the cartridge in the cartridge holder from the moving direction.

14. A drive method of operating a motor in an electronic device that includes: a cartridge holder which holds a cartridge; the motor for moving the cartridge holder in a moving direction; and a guide which is provided in the cartridge holder to mount the cartridge in the cartridge holder from the moving direction, the drive method comprising applying a voltage or a current to the motor for moving the cartridge holder to apply, to the cartridge holder, a resisting force in a direction facing an external force from a user, against the external force which is applied by the user along the moving direction to the cartridge holder through the cartridge during user mounting of the cartridge in the cartridge holder, wherein the voltage or the current is applied to the motor so that an absolute value of the resisting force is larger than an absolute value of the external force that is a predetermined minimum value required for mounting the cartridge in the cartridge holder, and the cartridge holder will not move or will only slightly move in the moving direction when there are predetermined external forces applied by the user to the cartridge holder through the cartridge that are equal to or greater than the predetermined minimum value during user mounting of the cartridge so that the user is able to still mount the cartridge in the cartridge holder despite the slight movement thereof.

* * * * *